United States Patent [19]

Girdler

[11] 3,958,277

[45] May 25, 1976

[54] TIE CLASP

[75] Inventor: George W. Girdler, Hialeah, Fla.

[73] Assignee: Jack Steinberg, Miami, Fla. ; a part interest

[22] Filed: Sept. 15, 1975

[21] Appl. No.: 613,172

[52] U.S. Cl. ..... 2/153

[51] Int. Cl.[2] ..... A41D 25/08

[58] Field of Search..... 2/145, 148, 149, 152 R, 2/152 A, 153, 154, 137; 24/153 BP

[56] References Cited

UNITED STATES PATENTS

| | | | |
|---|---|---|---|
| 758,073 | 4/1904 | Hodecker | 2/152 R |
| 2,774,971 | 12/1956 | Schrade | 2/153 |
| 3,588,918 | 6/1971 | Thistle | 2/153 |
| 3,755,821 | 9/1973 | Tellone | 2/153 |

FOREIGN PATENTS OR APPLICATIONS

| | | | |
|---|---|---|---|
| 376,279 | 8/1907 | France | 2/152 R |

*Primary Examiner*—G. V. Larkin

*Attorney, Agent, or Firm*—Robert B. Kennedy

[57] ABSTRACT

A tie clasp is disclosed for supporting neckwear. The tie clasp comprises a plate adapted to be positioned on the front of a shirt collar, hook means mounted on the back of said plate for suspending said plate from the shirt collar, and receiving means mounted on the back of said plate below said hook means through which neckwear may be passsed generally horizontally or vertically in draping the neckwear ends in mutual lateral or overlaid positions, respectively.

11 Claims, 6 Drawing Figures

TIE CLASP

BACKGROUND OF THE INVENTION

1. Field of the Invention

The invention relates generally to tie clasps for supporting neckwear, and particularly to tie clasps of the type adapted to be fitted on the front of a shirt collar with an item of neckwear suspended from the back thereof.

2. Description of the Prior Art

Heretofore, tie clasps have been devised for attachment to shirt collars between the collar wings from which neckwear may be held pendant. As exemplified by U.S. Pat. Nos. 2,774,971; 3,588,918; 3,631,541 and 3,881,196, these devices have typically comprised a plate having means for attaching the plate to the collar and a bar attached to or a slot provided in the plate forming a horizontal, upper tie support surface extending between the collar wings. With the clasp attached to a shirt collar, a necktie may be supported on the tie support surface with its end portions overlaying each other beneath the clasp.

Though tie clasps of the type just described have functioned satisfactorily in supporting neckties draped vertically from the clasps, they have not been suited for supporting other forms of neckwear such as Ascot ties, leisure or string ties or others having laterally suspended pendant ends. They have also been incapable of accommodating both neckwear sized to encircle a wearer's neck as well as that sized to bypass the neck. The prior art devices have exhibited only minimally acceptable stability in use as they have often tended to become skewed.

Accordingly, it is a general object of the present invention to provide an improved tie clasp.

More specifically, it is an object of the invention to provide a tie clasp from which neckwear ends may be draped in mutual lateral or overlaid positions.

Another object of the invention is to provide a tie clasp from which neckwear may be suspended sized either to encircle or bypass the wearer's neck.

Another object of the invention is to provide a tie clasp with means for readily affixing an ornament.

Yet another object of the invention is to provide a tie clasp which may be readily attached to a shirt collar and held snugly in place during use.

SUMMARY OF THE INVENTION

In one form of the invention a tie clasp is disclosed for supporting neckwear comprising a plate adapted to be positioned on the front of a shirt collar. Hook means are mounted on the back of the plate for suspending the plate from the shirt collar. Receiving means are also mounted on the back of the plate below the hook means through which neckwear may be passed generally horizontally or vertically in draping the neckwear ends in mutual lateral or overlaid positions, respectively.

DESCRIPTION OF PREFERRED EMBODIMENTS

Figure 1:
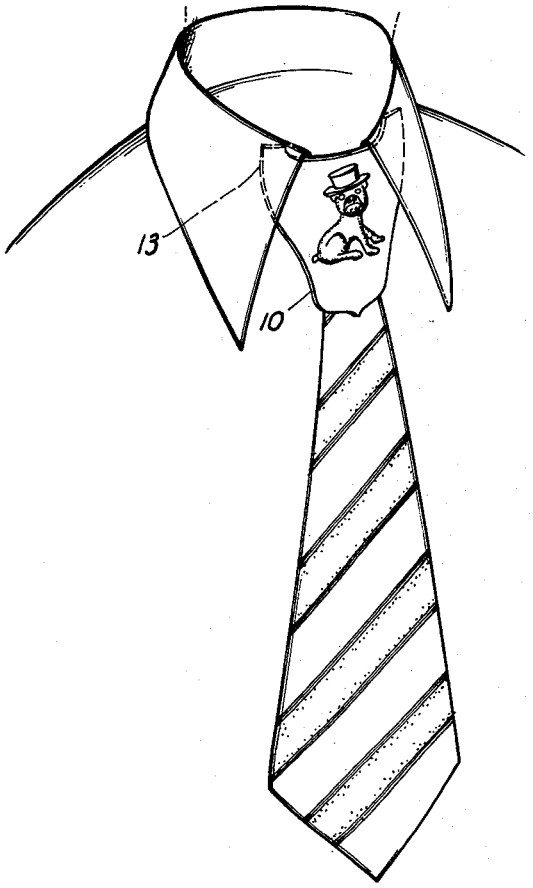
FIG. 1 is a perspective view of the front of a tie clasp embodying principles of the invention in a preferred form.

Referring now in more detail to the drawing, there is shown in FIGS. 1–5 a tie clasp 10 comprising a metallic plate 11 formed in the general shape of a shield having bilateral symmetry. The front surface of the plate is formed slightly convexed while the rear surface is formed slightly concaved. A hook 12 is rigidly mounted to the back of the plate along its vertical centerline beneath the two upper plate corners 13. These upper corners are detailed in shape to reside snugly beneath the shirt collar wings as shown in FIG. 1.

Beneath hook 12 is also mounted to the back surface of the plate along its vertical centerline a split collar 14. This collar is pivotably mounted to the plate by means of a pivot pin 15. The split collar is provided with two mutually confronting ends 27 and 28 which define a gap 29 therebetween over pivot pin 15. The collar provides a channel 30 for receiving neckwear therethrough. A pair of guides is provided by substantially straight bars 24 rigidly mounted to the back of the plate beneath plate corners 13. As the rear surface of the plate is slightly concaved, once the ends of the bars 25 are welded to the plate the intermediate portion of the bars is spacially displaced from the plate thereby providing channels 26 between the intermediate portions of the bars and the rear surface of the plate.

An ornament 18, here in the shape of a top-hatted bulldog, is provided for mounting to the front surface of the tie clasp. A thin, square plate 21 is rigidly mounted as by welding to the center portion of the front surface of the plate 11. This thin plate 21 is provided with a central aperture which overlays an aperture formed through the surface of plate 11. From the rear of ornament 18 projects a threaded stud 19 between two mutually spaced horizontal stop bars 23. A knurled nut 20 is provided for securing the ornament snugly to the plate.

In use, ornament 18 may be readily attached to the plate by passing threaded stud 19 through the mutually aligned apertures in plates 21 and 11 with bars 23 disposed about the upper and lower surfaces of thin, square plate 21. Nut 20 may then be run up on the threaded stud 19 to firmly secure the ornament to the front surface of the plate. In tightening the nut rotary movement of the ornament with respect to the plates is inhibited by the upper and lower surfaces of plate 21 which engage stop bars 23.

Figure 3:
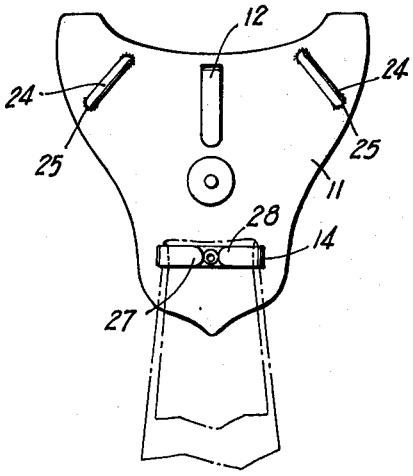
FIG. 3 is a rear elevational view of the device shown in FIG. 1 supporting a necktie with its pendant ends overlaying each other.

Once the ornament has been firmly attached to the plates, the plate itself may be secured to a shirt collar by passing hook 12 over the collar button area of the shirt collar between the shirt collar wings. In doing this the upper corners 13 are placed behind and in abutment with the collar wings. So attached, the plate is inhibited from being dislocated by the triangular arrangement of pressure points provided by hook 12 and the two upper corners of the plate disposed above the hook. A necktie may then be draped from the rear of the plate by passing it through the receiving means provided by split collar 14. In performing this the tie may be passed vertically through channel 30 or, alternatively, its midportion may be passed directly into the channel through gap 29. Once placed with its pendant ends overlaying one another, the tie assumes the position as shown in FIG. 3 with respect to the tie clasp.

Figure 2:
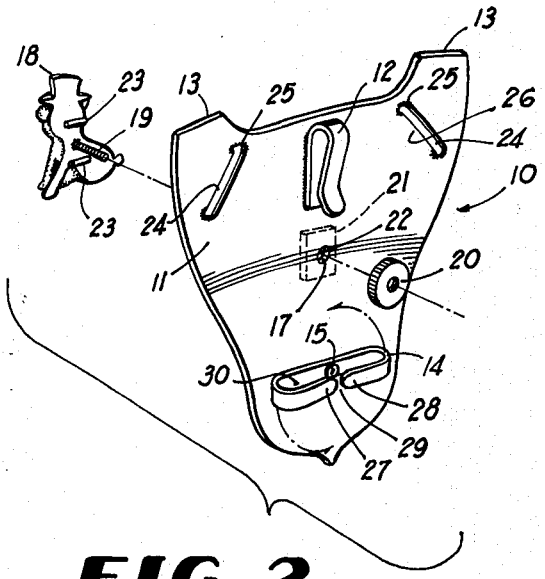
FIG. 2 is an exploded perspective view of the back of the tie clasp shown in FIG. 1.
Figure 4:
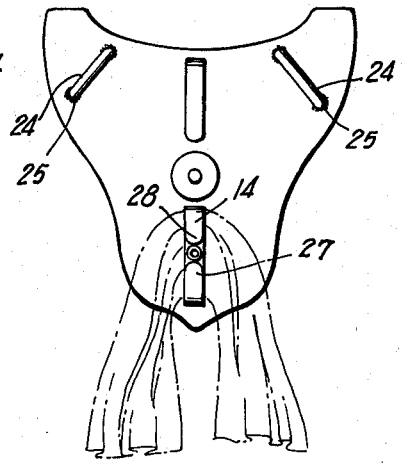
FIG. 4 is another rear elevational view of the device shown in FIG. 1 supporting Ascot type neckwear.
Figure 5:
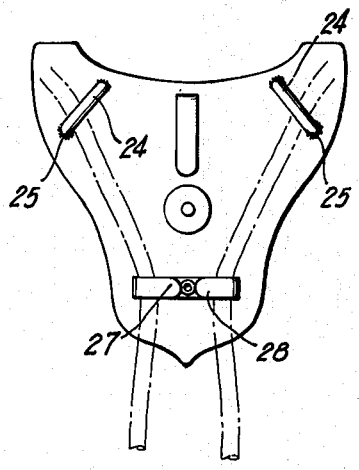
FIG. 5 also is a rear elevational view of the device shown in FIG. 1 supporting "leisure" neckwear.

For supporting a piece of neckwear with its pendant ends laterally spaced from one another, such as in the case of Ascot type neckwear, split collar 14 may be rotated, as shown by the arrows in FIG. 2, to a vertical orientation with respect to plate 11 as shown in FIG. 4. In this position neckwear may be passed generally horizontally through the channel 30 or directly into the channel through gap 29. Frictional engagement of the split collar with the rear surface of the plate inhibits the collar from rotating except at such times when substantial pressure is applied thereto as when manually gripped and rotated. Further versatility of the tie clasp is demonstrated in FIG. 5 where a leisure or string tie is seen to be supported. Here, the tie is seen to pass through both the split collar as well as beneath bars 24 and from there around the wearer's neck.

Figure 6:
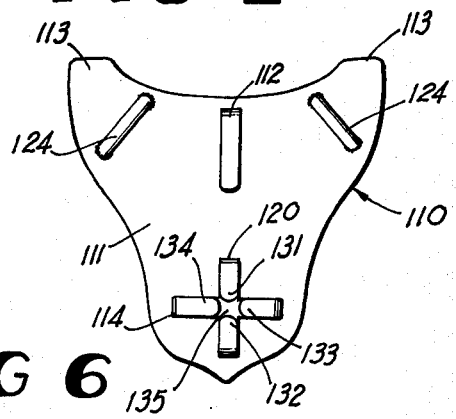
FIG. 6 is a rear elevational view of a tie clasp embodying other principles of the invention.

In FIG. 6 an alternative embodiment of the invention is shown wherein a tie clasp 110 is again seen to be in the shape of a shield having bilateral symmetry to which a hook 112 is mounted to the vertical centerline thereof. Again the tie clasp plate 111 is provided with two upper corners 113 located to either side of and slightly above hook 112. In this embodiment no ornament is provided; however, again a pair of guide bars 124 is mounted about hook 112 beneath upper plate corners 113. In this embodiment the neckwear receiving means is again provided by split collars. In this case, however, the neckwear receiving means is not pivotably mounted but is rather rigidly secured to the back surface of plate 111 beneath hook 112. Here, the receiving means comprises two split collars 114 and 120 mounted normal one another. Collar 114 has two confronting, spacially separated ends 133 and 134 defining a gap 135 therebetween while collar 120 similarly has two confronting, mutually spaced surfaces 131, 132 disposed about opposite sides of gap 135. With this construction neckwear may be passed vertically or horizontally through the receiving means by passing a midportion thereof beneath the confronting ends of that split collar into which it is to be placed and above the confronting ends of the other split collar. In performing this task the other split collar also serves as a guide in positioning the intermediate portion of the neckwear within the collar.

It should be understood that the just described embodiments merely illustrate principles of the invention in preferred forms. Many modifications, deletions or additions may, of course, be made hereto without departing from the spirit or scope of the invention as set forth in the following claims.

What is claimed is:

1. A tie clasp for supporting neckwear comprising a plate adapted to be positioned on the front of a shirt collar; hook means mounted on the back of said plate for suspending said plate from the shirt collar; and receiving means mounted on the back of said plate below said hook means through which neckwear may be passed generally horizontally or vertically in draping the neckwear ends in mutual lateral or overlaid positions, respectively.

2. A tie clasp as claimed in claim 1 wherein said receiving means comprises a split collar having mutually confronting ends defining a gap through which neckwear may be inserted into the receiving means.

3. A tie clasp as claimed in claim 2 wherein said receiving means includes a second split collar having mutually confronting ends disposed about opposite sides of said gap.

4. A tie clasp as claimed in claim 1 further comprising neckwear guide means mounted on the back of said plate about opposite sides of said hook means.

5. A tie clasp as claimed in claim 4 wherein the back of said plate is concave and wherein said neckwear guide means includes a pair of substantially straight bars having end portions joined to said plate and body portions intermediate said end portions spaced from said plate whereby neckwear may be passed through said guide means between said plate and said bars.

6. A tie clasp as claimed in claim 1 wherein said plate has a hole in the front thereof and wherein said tie clasp further comprises an ornament mounted to the front of said plate having a projection extending rearwardly therefrom into said plate hole.

7. A tie clasp as claimed in claim 6 wherein said hole extends through said plate, said ornament projection extends through said hole and is helically threaded, and said tie clasp further comprises a nut threaded about said projection adjacent said hook means in abutment with said plate.

8. A tie clasp as claimed in claim 6 further comprising complementary stop means on said ornament and said plate for inhibiting rotary motion of said ornament with respect to said plate.

9. A tie clasp as claimed in claim 1 wherein said plate includes integral plate sectional means above said hook means for stiffening the shirt collar detailed in shape and contour to reside in abutment with the shirt collar wings and in cooperation with said hook means also holds the tie clasp firmly positioned on the shirt collar.

10. A device for supporting neckwear comprising a plate adapted to be received on the front of a shirt collar with the back side of said plate adjacent the shirt collar, a hook rigidly mounted on the back of said plate adapted to suspend said plate from the shirt collar between the collar wings, and a clasp pivotably mounted on the back of said plate beneath said hook having a channel through which neckwear may be passed in a plurality of directions with respect to said plate and the shirt collar.

11. A device as claimed in claim 10 wherein the back surface of an upper portion of said plate is concave, and wherein said device further includes a pair of guide bars attached at the ends thereof to said concave plate surface thereby defining guide channels between said guide bars and said plate through which neckwear may also be passed.

* * * * *